US006296134B1

(12) United States Patent
Cardinale

(10) Patent No.: US 6,296,134 B1
(45) Date of Patent: Oct. 2, 2001

(54) INSULATED WATER-TIGHT CONTAINER

(76) Inventor: Salvatore J. Cardinale, 418 Maple St., Mill Valley, CA (US) 94941

( * ) Notice: Subject to any disclaimer, the term of this patent is extended or adjusted under 35 U.S.C. 154(b) by 0 days.

(21) Appl. No.: 09/435,245

(22) Filed: Nov. 5, 1999

(51) Int. Cl.[7] ..... B65D 3/22

(52) U.S. Cl. ..... 220/62.21; 220/62.22; 220/62.13; 220/495.05

(58) Field of Search ..... 220/62.22, 62.2, 220/62.21, 62.19, 62.12, 62.13, 62.11, 1.6, 495.05

(56) References Cited

U.S. PATENT DOCUMENTS

| | | | | |
|---|---|---|---|---|
| 3,754,642 | | 8/1973 | Stidolph . | |
| 3,772,712 | * | 11/1973 | Renn et al. | 4/484 |
| 3,952,940 | * | 4/1976 | Malcolm . | |
| 3,957,195 | * | 5/1976 | Lin . | |
| 4,194,439 | * | 3/1980 | Zimmermann | 493/56 |
| 4,284,205 | * | 8/1981 | Hirata | 220/418 |
| 4,439,298 | * | 3/1984 | Ford et al. | 204/258 |
| 4,621,380 | * | 11/1986 | McGill | 4/476 |
| 4,660,737 | * | 4/1987 | Green et al. | 220/410 |
| 4,682,708 | | 7/1987 | Pool . | |
| 4,854,474 | * | 8/1989 | Murray et al. | 220/462 |
| 4,889,252 | | 12/1989 | Rockom et al. . | |
| 5,009,326 | | 4/1991 | Reaves et al. . | |
| 5,062,527 | | 11/1991 | Westerman . | |
| 5,314,088 | * | 5/1994 | Hueberger et al. | 220/465 |
| 5,638,978 | | 6/1997 | Cadiente . | |
| 5,799,818 | * | 9/1998 | Ringer | 229/117 |

FOREIGN PATENT DOCUMENTS

| | | |
|---|---|---|
| 10-230993 | 2/1997 | (JP) . |
| WO 98/43028 | 10/1998 | (WO) . |

* cited by examiner

*Primary Examiner*—Stephen Castellano
(74) *Attorney, Agent, or Firm*—Thomas W. Cook

(57) ABSTRACT

An insulated container for shipping, transporting, or storing warm or cold items is disclosed, useful for maintaining temperature of items stored or shipped within the container, the container assembly consisting of at least one layer of rigid or semi-rigid material, and at least one layer of flexible, thermally insulating, water-resistant material, in the form of a pouch, which pouch is secured to the rigid material at areas which allow easy reconfiguration of the container to form a finished container having desirable insulating and water-resistant characteristics.

16 Claims, 4 Drawing Sheets

INSULATED WATER-TIGHT CONTAINER

TECHNICAL FIELD OF THE INVENTION

The present invention relates to an insulated container for shipping, transporting, or storing warm or cold items. More particularly, the present invention relates to a new thermally insulated container assembly, which assembly is water-tight as well as insulated so that fluids associated with the contents of the container may be retained within the container during storage or shipment. The container assembly utilizes a layer of rigid or semi-rigid material, and at least one layer of flexible, thermally insulating, water-resistant material, in the form of a pouch, fastened to the rigid material in such fashion as to allow easy and inexpensive manufacture, compact storage in a "knock down," substantially flat, configuration. When desired, a user may quickly and conveniently manipulate the knock down assembly to form a finished container having desirable insulating and water-resistant characteristics, in which the user may keep or store warm or cold items with their associated fluids.

BACKGROUND ART OF THE INVENTION

In many insulated containers, rigid materials are combined with insulating materials to form containers having insulating properties. By use of such containers, product suppliers may ship perishable products refrigerated or at room temperature, live or frozen, to customers while controlling the environment in which the perishable products are placed, or while simply extending the useful life of such products before they spoil. Examples of such uses for containers used in shipping include the shipment of fresh fish, in which a customer has requested that the product not be frozen, fresh flowers, around which a cool and moist environment should be maintained, and frozen tissues for research. With all such products, maintenance of constant, or low temperature, will help preserve freshness and quality of the products, or extend the useful life of the products, and often thereby increase the distance over which such products may be shipped, as extending the time during which a product is preserved extends the time for shipment during which such product may reach its destination.

In other insulated containers of this same general description, the usefulness of the container is in preserving the temperature of foods or beverages used in picnics, family outings, ball games, and other recreational activities.

Containers of this type which have been successfully employed for these purposes include insulated contains made from cardboard and individual pieces of insulating material, such as styrofoam or other lightweight foam type insulation. This type of container is often constructed by gluing the individual pieces of the insulating foam material to the interior surfaces of the cardboard, which is formed as a box, or by inserting separate foam pieces to insulate each container surface. While this type of container offers advantageous high thermal resistance, cutting and gluing pieces of foam to construct the finished container requires substantial assembly time, with the result that containers formed in this way are expensive to assemble.

Containers of this type also include insulated containers made of plastic foam. Typically this type of insulated container is composed of expanded polystyrene foam, which is formed in a mold to the desired shape, in which the foam provides the dimensional structure of the container as well as the thermally insulative barrier. In some cases, additional corrugated pieces may be used to provide additional structural support. While this type of container also offers high thermal resistance and, in addition, ease of assembly, the resulting container is rigidly set in its final form at the time of manufacture, with the result that this type of container requires substantial floor space and volume to store and transport prior to, during, and after use. Moreover expanded polystyrene is generally considered to have a high impact on the environment as undesirable byproducts are released upon its manufacture. In addition, polystyrene decomposes slowly, and, due to its airy and bulky nature, it occupies a large volume in land fill disposal sites.

Another type of container generally suited for shipment of perishable products consists of generally rigid walls made of corrugated cardboard or other suitable material, to which is bonded a flexible, sealable, insulative material having bubbles of air entrapped therein to provide thermal insulation. One form of such material is commonly referred to as "bubble wrap," however rubber or plastic foam or other material having the characteristics described herein may be employed in the present invention. The flexible material may have a reflective surface, or an additional layer of flexible reflective material, attached to the rigid walls or flexible, sealable, insulative material, to increase thermally resistant efficiency. While this type of container is well suited to some applications, and has distinct advantages over other type of insulated containers, the containers of this type appearing in prior art do not allow for easy assembly by a user, with resulting savings in time and costs, and do not result in water-tightness in the container for retention of fluids, or runoff from melting ice, associated with the products shipped.

It may be appreciated, in light of the foregoing discussion, that there is a need for an environmentally friendly, affordable, insulated container, suitable for shipping perishable products, and suitable for providing convenient temperature control when conducting recreational activities, where the container is easy to manufacture, thermally resistant, water-resistant and watertight, lightweight, compact prior to assembly, and easy to assemble by a user. The present invention is directed precisely to such useful characteristics.

A number of schemes have been devised to accomplish one or more of the goals set forth above. These schemes include single-piece and multi-part containers of cardboard, foam, and plastic flexible, sealable, insulative material materials. Various designs and configurations for such apparatus include:

U.S. Pat. No. 3,754,642 to Stidolph, which discloses a waterproof container for shipping and displaying perishable products.

U.S. Pat. No. 4,682,708 to Pool, which discloses a paperboard shipping container having non-rigid, foamatious insulating material, and a plastic bag placed between the paperboard and insulating material.

U.S. Pat. No. 4,889,252 to Rockom et al., which discloses an insulated container formed of corrugated paperboard and a layer of flexible material having air bubbles and foil.

U.S. Pat. No. 5,009,326 to Reaves et al., which discloses an insulated multi-part container of corrugated cardboard, folded and stapled to form an enclosure, with one-piece insulated liner.

U.S. Pat. No. 5,638,978 to Cadiente, which discloses an insulated waterproof container for the shipment of produce.

In the above-noted inventions, and in other prior art, cardboard, when formed into a box, is a popular material in the shipping industry because it is inexpensive and relatively light weight when compared to its strength. As a result, insulated containers composed in part of cardboard or paperboard help minimize shipping costs. However, cardboard alone is not suitable in those applications in which temperature should-be maintained within the container, and it is not suitable in those applications where the contents of the container is a fluid, such as water, or where fluid is important to preserving the contents.

Prior efforts at achieving a suitable container for such purposes have therefore focused on configurations and materials which have desirable characteristics when used in combination with cardboard, or which have both rigidity and such characteristics when used without cardboard. As a result, various inventions of the prior art, such as those of the above-noted patents, employ combinations of various insulating materials, whether rigid or flexible, and water-tight or water-resistant layers or barriers. A variety of insulating and water-resistent effects may be achieved where these materials are combined and formed as directed by prior art. Thus, good insulative properties are achieved by containers utilizing preformed foam, however preformed foam does not allow compact storage, while foam sheets requires expensive assembly and cannot achieve water-tightness. In the alternative, cardboard with flexible plastic bubble sheets may be easy to manufacture, however most such arrangements are not water-tight, or are time consuming for a user to assemble if stored and shipped in compact, "knock down" form. In addition, the construction of such arrangements are somewhat expensive because multiple sheets are required.

The present invention is directed to combining desirable features to achieve an insulated container suitable for shipment or storage of a wide variety of products, particularly perishable products. While the devices disclosed in prior patents fulfill their respective objectives, prior patents and inventions do not describe or suggest an insulated, water-tight container, easy and inexpensive to manufacture, compact in storage and shipment, and quickly reformed by a user to produce the final container having the desirable characteristics mentioned herein.

DISCLOSURE OF INVENTION

Summary of the Invention

An insulated container utilizing corrugated cardboard or paperboard to achieve structural rigidity consists in its simplest form of the cardboard, an insulating material, and perhaps a means for resisting the transmission of fluids or vapors through the cardboard. The insulating material is typically fastened to the cardboard, or simply placed within the cardboard after the cardboard is formed into an open box. The means for containing fluids or vapors, if present, may be placed inside the insulating material, or between the insulating material and the cardboard.

The present invention provides a new assembly, easy and inexpensive to manufacture, and compact in its folded "knock down" configuration, in which configuration the assembly may be stored or shipped while occupying a minimum of space. The present invention is an assembly easy for a user to quickly reconfigure into a insulated and water-tight container, which container is suitable for storing or shipping products requiring a controlled temperature, and which container may hold fluids and vapor found with the remaining contents of the container.

In one preferred embodiment of the present invention, an insulated container assembly is comprised of an outer rigid or semi-rigid outer container or box, and a one-piece insulated liner in the form of a bag or pouch. The outer container may be composed of corrugated cardboard, paperboard, plastic, or other material having sufficient structural rigidity and strength to satisfy the application at hand. Accordingly, corrugated cardboard is the likely material of choice for an insulated container designed to ship cut flowers, and for many other applications, while colored plastic might be more suitable to, and therefore chosen for, a picnic basket or sporting event beverage cooler application.

The outer container generally will include four sides, a top and a bottom, or flaps which form a top and a bottom when folded over the opening at the end of the container formed by the four sides. The top or the flaps, may be appended to the rigid or semi-rigid side walls of the container. The top of the outer container, or the top flaps may, in addition, feature a handle, or be capable of being formed into a handle, for ease of carrying the finished insulated container, or the outer container may carry, separately from the top or flaps, a handle attached to its exterior.

The bottom of the outer container will usually comprise bottom flaps, generally sealable by tape or in other ways typically found in similar containers. However, the bottom of the outer container is best closed and sealed simply, and without such external sealing materials. In one such closure and sealing arrangement, the bottom may consist of four flaps, two of which bear cutouts for insertion of the ends or corners of the other two remaining flaps, which remaining flaps may be scored for easy bending or folding.

The one-piece insulated liner of the present invention may be formed from one or more sheets of flexible, thermally insulative, waterproof material, or the liner may be formed from separate sheets having only one of these properties each. Generally, however, both thermal insulation and waterproofing may be most simply accomplished in a single sheet utilizing recently available and inexpensive materials. One material of choice using currently available materials is a flexible plastic layer having at least one layer of air bubbles entrapped therein laminated to a layer of metalized polyester or foil (sometimes commonly known as "bubble wrap"). This flexible, sealable, insulative material may be formed in a variety of ways, but is commonly formed by bonding a first layer of smooth plastic to a second layer of plastic having a surface with regularly spaced depressions pushed into it. Upon bonding, the first and second layer adhere in areas in which depressions are not formed, while remaining separated layers at the areas of the depressions. The result of such bonding is entrapment of air in the areas of the second layer in which the depressions were formed. A third layer of plastic is often then bonded to the depression areas of the second layer of plastic, thereby further entrapping air between the second plastic sheet and the third sheet of plastic. Further plastic sheets, creating more bubbles, may be added in this way to increase thermal resistivity. The three sheets after such fabrication together create a single sheet of flexible, sealable, insulative material. One or more of the individual sheets of plastic comprising the flexible, sealable, insulative material may be composed of a plastic having reflective properties, to thereby reduce heat transfer by radiation. In the alternative, another layer of reflective plastic or other material may be attached to the flexible, sealable, insulative material, or separately used with the flexible, sealable, insulative material to reduce heat loss by radiation.

In one preferred embodiment, a single sheet of flexible, sealable, insulative material is simply cut into a rectangular shape, folded over once, and the cut edges matched. The two opposing edges of the flexible, sealable, insulative material are then sealed, leaving unsealed the remaining edges, i.e.

those most distant from the fold line, thereby forming a pouch, with top opening away from the fold line. Alternatively, a single sheet may be folded over after being cut, and sealed along a side adjacent to the fold line and along a side opposite the fold line. However the material is sealed, however, the sealing of edges to create a pouch may be accomplished by the application of heat to the areas to be sealed as such areas are pressed together. The combination of heat and pressure causes the flexible plastic material to melt slightly, popping many bubbles which may be incorporated into the material, and bonding together successive layers of plastic. The cutting and sealing as described results in water-tight and insulative pocket, which may be expanded to allow the insertion of articles, or which may remain flat as originally folded and sealed.

The plastic flexible, sealable, insulative material is cut to a width which, when so folded and sealed, will fit conveniently within the side walls of the outer container when the outer container is flattened into its knock down configuration. As so sized, the flexible, sealable, insulative material will also fit conveniently within the side walls of the outer container when it is expanded to its final three dimensional shape, and may follow the side walls in such expansion if attached to them. The flexible, sealable, insulative material is also cut to a length which, when so folded, sealed, and placed within the outer container, will extend through the outer container when it is flattened, and out the ends of the flattened container. When so placed within the outer container, the base of the pocket of insulating material, at the fold line, extends from the bottom of the outer container, while the opening of the pocket, away from the fold line, may extend from the top of the outer container to allow ample material to overlap or join the top edges of the flexible, sealable, insulative material pouch to seal it after constructing and loading of the container.

The distance the base of the pocket of insulating material extends from the bottom flap fold line of the container is approximately equal to or greater than one half the length of the shortest side wall. Utilizing these dimensions, the pouch will often, but not always, extend from the bottom of the outer container approximately one or two inches. As a result, the pocket may be drawn open to form a square or rectangle when viewed from either top or bottom, and the dimension of the resultant square or rectangle allows the pocket of insulating materials to approximately cover the area occupied by the outer container in its expanded configuration, when view from the top or the bottom. The distance the opening of the pocket of insulating material extends from the top flap fold line of the container is equal to or greater than one half the length of the shortest side wall. As a result, the top of the pocket has sufficient material to cover the area occupied by the outer container, when viewed from the top or the bottom, in its expanded configuration. The top of the pocket also has sufficient material to allow sealing of the top of the pocket, even in its expanded configuration, as the opening of the pocket of insulating material extends from the top of the container a distance greater than one half the length of the shortest side wall.

At the time of manufacture, the pocket of insulating material is inserted into the outer container and positioned as set forth above. Once in position, the pocket is attached, at or near its mid-line between its two side edges, to or near the corresponding corners of the outer container. The attachment points are best located along both sides of the pouch, at or near its mid-line, and on each side wall of the outer container near the pouch mid-line once assembled (i.e., near the "corners" of the outer container). These are the primary areas for attachment between the pocket and the outer container. The pocket may also be attached, at or near its two side edges, to the remaining two corresponding corners of the outer container, near the fold lines at the intersection of the side walls. The means for attachment of the insulating material to the corners of the outer container may be glue, tape, a combination of glue and separable tape of the "velcro" type, or by any other means which does not pierce the insulative material, or cause unequal strain at any point in the material. However, methods of attachment which allow for removal of the insulated pocket from the outer container have the additional advantage of allowing cleaning of the pocket separate from the cardboard, thereby preserving the structural integrity of the cardboard against weakening by contact with water, and recycling the outer container and insulative pocket separately.

As a result of manufacture in the method described herein, the present invention may be incorporated into an insulated container assembly which is capable of being folded flat, with side walls of the outside container in the knock down configuration, and with the flattened flexible, sealable, insulative material pocket residing within the side walls.

To utilize the present invention, a user may select a flattened container of appropriate size, and manipulate the outer container to expand it just as a user would expand any other cardboard box in the prior art. Upon such expansion, however, the flexible, sealable, insulating pocket of one version of the present invention is pulled along with the side walls of the outer container, thereby filling the volume created upon its expansion. At the top of the box, the opening of the flexible, sealable, insulative material pocket opens naturally when the outer container is expanded, thereby allowing placement of articles within the pocket and the outer container. At the bottom of the outer container, the bottom of the pocket is reformed as the corners of the outer container, at the fold lines between side walls, pull the sides of the pocket, at or near its mid-line, away from the main body of the pocket. At the same time, and in response to such pulling, the sealed edges of the pocket are pulled inward toward the main body of the pocket.

The user continues to expand the outer container until it reaches a point at which the side walls are perpendicularly oriented to their adjoining sidewalls, and the bottom or bottom flaps may be manipulated into position to close the outer container at its bottom. At the point of maximum expansion of the outer container, the insulated pocket is reformed so that the flexible, sealable, insulative material runs in substantially a straight diagonal line across the bottom of the outer container, between two opposing corners of the outer container. Meanwhile, as the outer container is opened, the sealed side edges of the flexible, sealable, insulative material pocket near the remaining corners of the outside container are drawn toward the center of the bottom of the outer container, and the bottom of the insulating pouch is pulled toward the center of the outer container until the container is fully expanded. At full expansion of the outer container, the bottom center of the pouch will be positioned approximately even with the bottom flap fold line, and about equidistant between the bottom flaps.

In this position, the bottom of the outer container, or the flaps which may function to close the bottom of the outer container, may be easily placed or folded over the bottom of the outer container, and secured in place by appropriate means. In a rectangular "snap lock" bottom box design, bottom closure is normally accomplished when the longer bottom flaps are folded in, and the shorter flaps are folded in and locked into place. On a standard carton, the bottom closure sequence is reversed, the shorter flap being folded in first, and the longer flaps secured in place after and over the shorter flaps. Closure of the insulative pocket at its top then may proceed by folding the flexible, sealable, insulative material, and securing it in place, or otherwise securing the ends of the sheet of flexible, sealable, insulative material to form a closure. Such closure may be accomplished in a variety of ways currently in use, including use of a "lip & tape" (or lip with adhesive, or pressure sensitive tape) foldover design, in which materials, secured near the edges of the pocket opening, are used to close the pocket upon folding. However, a preferred method of closure in the commercial shipping market is through use of a portable roller/sealer, in which a user may apply, generally by hand, both pressure and heat to melt the edges of the pocket opening together. By such means, a user may create a pocket having water-tight characteristics even if the container as a whole is upended during shipment. Upon completing the closure of the flexible, sealable, insulative material pocket, the user may close the outer container in the way dictated by the design of the outer container.

By the above process, the user may store the insulated and water-tight container assembly in its knock down configuration pending use, select and quickly manipulate assembly to reconfigure the assembly to its final shape, and secure the assembly in such final shape, ready to receive articles. The reconfiguration process is both quick and convenient for the user, and the resultant container inexpensive and readily available.

Further, by means of the present invention, a manufacturer may quickly and inexpensively provide a light weight, durable, insulated, and water-tight container which may be manipulated into its final shape by the user, and store and ship such assembly using a minimum of space and cost.

The more important features of the invention have thus been outlined, rather broadly, so that the detailed description thereof that follows may be better understood, and in order that the present contribution to the art may be better appreciated. Additional features of specific embodiments of the invention will be described below. However, before explaining preferred embodiments of the invention in detail, it may be noted briefly that the present invention substantially departs from pre-existing designs of the prior art, and in so doing provides the manufacturer and distributer with the highly desirable ability to easily and inexpensively manufacture the new assembly in a compact, folded "knock down" configuration, and store or ship the assembly in such configuration while occupying a minimum of space. The design of the present invention has distinct advantages over prior art. Thus, the assembly of the present invention provides an assembly easy for a user to quickly reconfigure into a insulated and water-tight container, which container is suitable for storing or shipping products such as flowers, fruits, beverages, or other products requiring a controlled temperature. It also allows the insulated container incorporating the design to hold fluids and vapor within the container thereby increasing insulative properties of the container, while preventing fluids from leaking through the container with resultant mess and loss of structural integrity. It also provides a water-tight or water-resistent liner in a collapsible, structurally rigid exterior, for space saving storage of thermally sensitive contents and any associated fluids. Accordingly, this water-tight container design satisfies airline cargo regulations relating to shipping with water and ice, and melted ice runoff containment. The rigid exterior of the present invention may itself be manufactured with water resistant adhesives for durability and reusability. Finally, the assembly of the present invention is designed and composed of such materials that it utilizes less material overall in construction and, eventually, disposal, without the use of cloroflorohydrocarbons (CFCs), while the construction of the assembly allows reuse. Accordingly, the assembly is less environmentally burdensome.

These consequences arising by use of the present invention result in substantial savings in user time, and substantial savings in expense in manufacture and distribution, and reduction in storage area until the user determines that a container having the characteristics noted herein are required, at which point the insulated container system of the present invention is simply applied to the task at hand.

Objects of the Invention

The principal object of the present invention is to provide a new insulated container assembly for use in transporting temperature sensitive goods, with the additional characteristic of providing a means for retaining fluids and vapors within the container.

A further object of the present invention is to provide an insulated container assembly which may be inexpensively and easily manufactured utilizing standard, readily available materials.

A further object of the present invention is to provide an insulated container assembly which may be transported and stored when not in use in a flattened configuration, thereby preserving space and reducing transportation and storage costs.

A further object of the present invention is to provide an insulated container assembly which is quickly and easily expanded by a user from its folded configuration to its configuration when in use.

A further object of the present invention is to eliminate the need for voluminous, rigid, three dimensional insulating liners which must be carried separately, and placed in position within a container after it has been expanded.

A further object of the present invention is to provide consumers with a convenient, more environmentally sound option to the disposable coolers currently constructed of expanded polystyrene foam.

A further object of the present invention is to provide an insulated, water-tight container utilizing an interior pocket of standard size which may be fitted to a rigid outer container of varying dimentions.

BRIEF DESCRIPTION OF DRAWINGS

The invention will be better understood and objects other than those set forth above will become apparent when consideration is given to the following detailed description thereof. Such description makes reference to the annexed drawings wherein.

DESCRIPTION OF A FIRST PREFERRED EMBODIMENT

Figure 1:
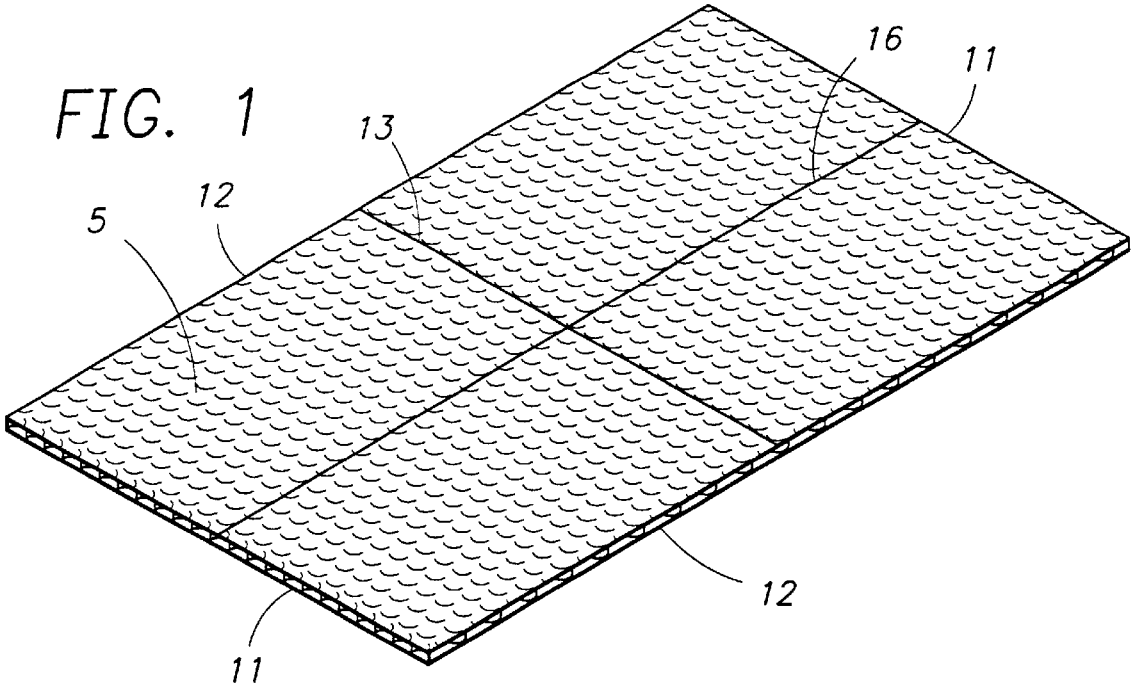
FIG. 1 is a top-side perspective view of a flexible plastic layer having at least one layer of air bubbles entrapped therein laminated to a layer of metalized polyester or foil.

Referring initially to FIG. 1, a flexible plastic layer 5 having at least one layer of air bubbles entrapped therein laminated to a layer of metalized polyester or foil (sometimes commonly known as "bubble wrap") is shown. The layer 5 has edges 11 at each end, edges 12 along each side, and a central fold line 13 approximately half way between edges 11 at each end of layer 5.

Figure 2:
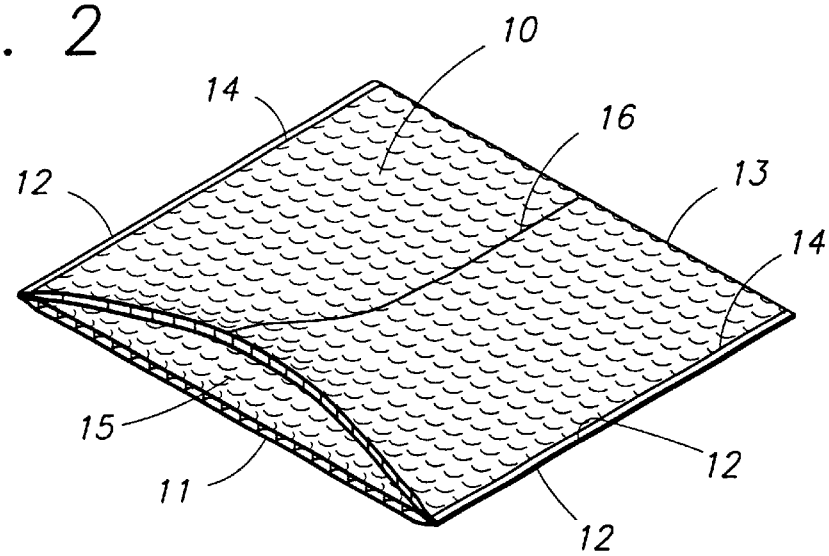
FIG. 2 is a top-side perspective view of the flexible plastic layer of FIG. 1, in which the layer has been folded once, and the edges matched and sealed after folding to create a pouch.

In FIG. 2, the flexible plastic layer 5 of FIG. 1 is shown folded along its central fold line 13, end edges 11 have been matched with each other, and side edges 12 have been matched with themselves. In such position, side edges 12 are sealed along their length, generally creating a seal line 14. Upon sealing, the layer 5 forms a pouch 10 with an opening 15, two sealed side edges 12, a fold of continuous material at the central fold line 13, and a pouch mid-line 16 on each exterior side of the pouch 10.

Figure 3:
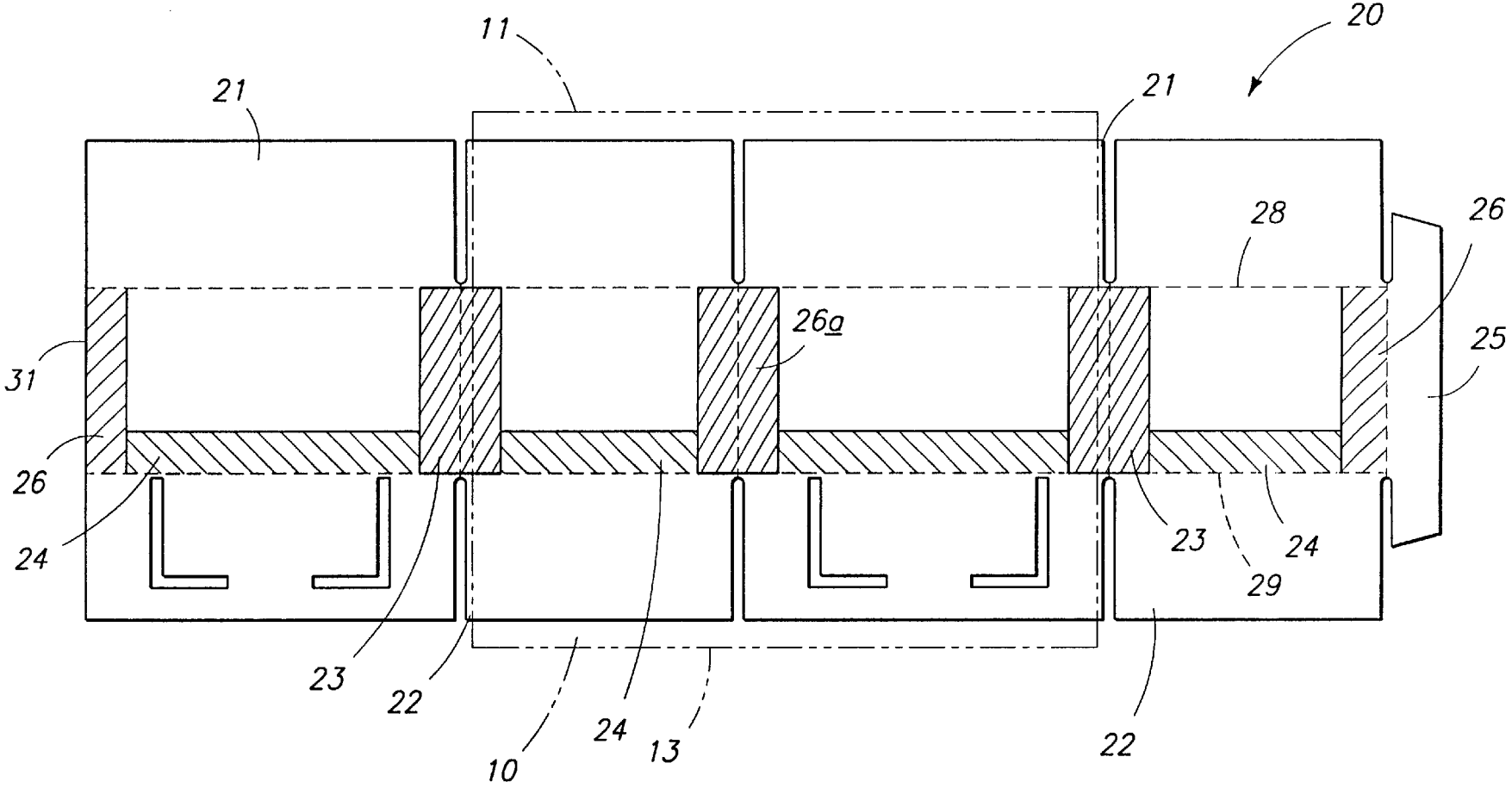
FIG. 3 is a plan view of a rigid or semi-rigid outer container prior to its assembly, and showing preferred areas for application of adhesive.

Referring now to FIG. 3, a single piece of rigid or semi-rigid outer container 20 is shown opened out prior to its assembly. Top flaps 21 and bottom flaps 22, and a single fastening flap 25 are formed from the container material by cutting away excess material. At the end opposite fastening flap 25, mating edge 31 is shown. After such cutting, top flaps 21 and bottom flaps 22 may be easily folded at top flap fold lines 28 and bottom flap fold lines 29. FIG. 3 also shows first preferred areas 26 and **26*a* for application of adhesive which will eventually be used to attach the pouch of FIG. 2 to the outer container 20. Preferred areas 26 and 26*a* are the most important areas to establish such attachment, as these areas correspond approximately to the mid-line 16 on each side of the pouch 10, however additional adhesive may be applied to other, secondary areas 23 and additional areas 24** in some applications if additional strength is desired.

When constructed as set forth in FIG. 3, a convenient method of manufacture of the outer container 20 is disclosed, so as to make assembly with pouch 10 possible with minimal expense and effort. In such assembly, outer container 20 is first cut as shown in FIG. 3, and adhesive (not shown), or an adhesive strip (not shown), is applied or secured to the preferred areas 26 and **26*a*, after which pouch 10 is set on container 20 so that pouch mid-line 16 rests on or near the middle preferred area 26*a* at the center of outer container 20. By such placement, pouch 10 is placed in contact with the adhesive or adhesive strip of the middle preferred area 26*a* near the mid-line 16 of pouch 10, and is thereby secured to such area. In such position, pouch end edges 11 may extend beyond top flaps 21, and pouch bottom at fold line 13 may extend beyond bottom flaps 22. After placement of pouch 10, the ends of outer container 20 may be folded across pouch 10 in such a way as to position fastening flap 25 over the outside of mating edge 31 of container 20, and fastening flap 25 may then be secured to mating edge 31 utilizing the same adhesive used to secure pouch 10 to preferred areas 26 of outer container 20. In this way, a single application of adhesive may be used to secure the pouch 10 to the container 20 at preferred areas 26**, and also close the container over the pouch during assembly of the invention.

Figure 4:
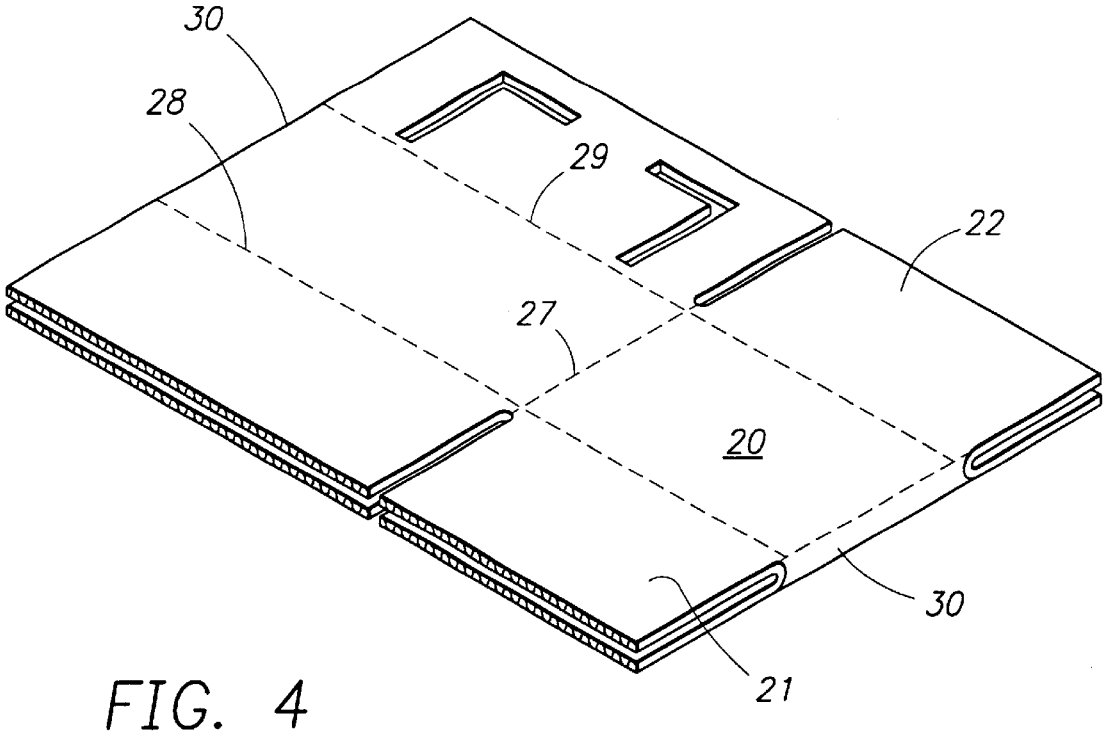
FIG. 4 is a top-side perspective view of a the rigid outer container of FIG. 3, in which the ends container material have been attached to each other to create the shape of a folded box.
Figure 6:
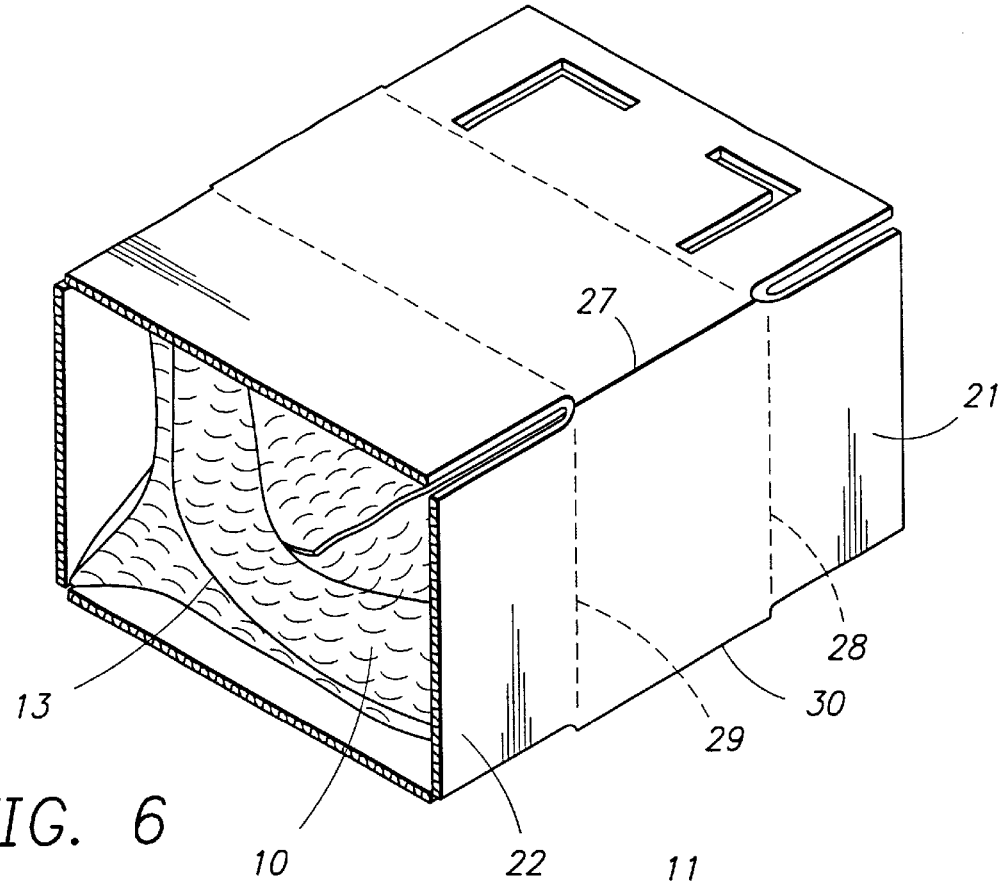
FIG. 6 is a bottom-side perspective view of the rigid outer container of FIG. 5, into which the flexible plastic pouch of FIG. 2 has been placed, and the outer container expanded to create a volume into which objects may be placed. When so viewed from the bottom, the folded bottom portion of the pouch has followed the outer container in its expansion, thereby also expanding the bottom of the pouch.

In FIG. 4, the rigid or semi-rigid outer container 20 is shown with its ends fastened utilizing fastening flap 25, thereby creating an angular tube of rigid or semi-rigid material capable of lying flat (as shown), or expanding into a rectangular tube shape (as shown in FIG. 6). Top flaps 21 are attached to the main body of the outer container at fold lines 28, while bottom flaps 22 are attached to the main body of the outer container at fold lines 29. The outer container has been folded at fold lines 30, while additional fold lines 27 (top fold line only is shown) allow expansion of the outer container 20.

Figure 5:
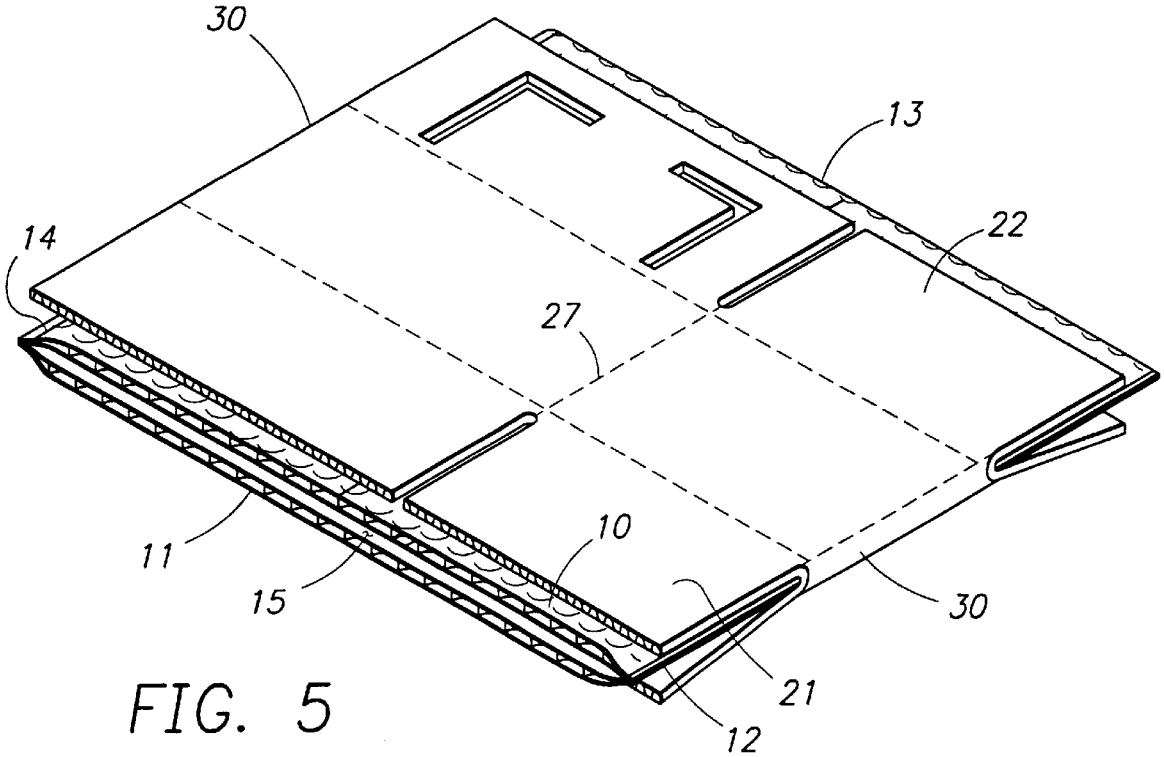
FIG. 5 is a top-side perspective view of a the rigid outer container of FIG. 4, into which the flexible plastic pouch of FIG. 2 has been placed. The pouch and outer container have been attached one to the other at the areas indicated for adhesive shown in FIG. 3.

In FIG. 5, the rigid outer container 20 is again shown, and again folded along fold lines 30, with additional fold lines 27, as in FIG. 4. In FIG. 5, however, the flexible plastic pouch 10 of FIG. 2 has been placed with top edges 11 protruding beyond top flaps 21 of outer container 20, and pouch bottom 13 protruding beyond bottom flaps 22 of outer container 20. In such position, the seals 14 along side edges 12 and the opening 15 of the pouch are readily apparent. The pouch 10 is fastened into this position with adhesive applied to preferred adhesive areas 26, as shown and described in FIG. 3.

In FIG. 6, the rigid outer container 20 is again shown viewed from its bottom, in its expanded configuration, with bottom flaps 22 and bottom flap fold lines 29 nearest the viewer, and top flaps 21 and top flap fold lines 28 away from the viewer. Fold lines 27 and 30 are again apparent. The insulative pouch 10 shown in FIG. 2 is also apparent through the bottom of the outer container, the flexible, insulative layer 5, with fold line 13, appearing through the bottom of the outer container. In such position, the bottom portion of the pouch has followed the outer container 20 in its expansion, thereby also expanding the bottom of the pouch 10.

Figure 7:
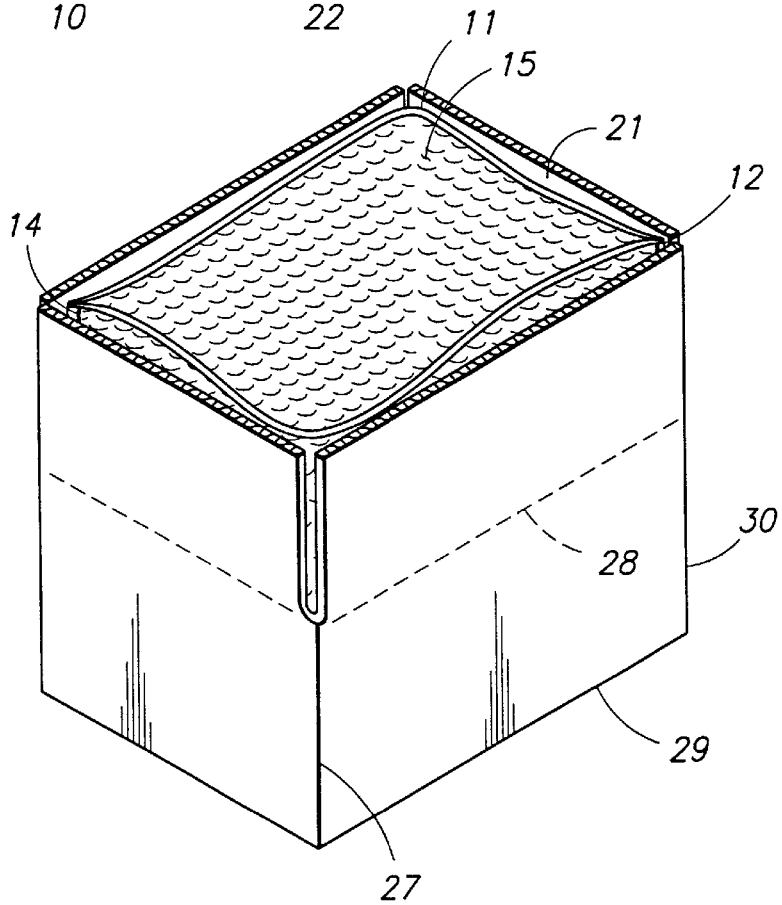
FIG. 7 is a top-side perspective view of a the rigid outer container of FIG. 5, into which the flexible plastic pouch of FIG. 2 has been placed, and the outer container expanded to create a volume into which objects may be placed. The pouch, at its top, has also followed the outer container in its expansion, thereby opening the top of the pouch to receive objects.

Referring to FIG. 7, the rigid outer container 20 is again shown, with pouch 10, in their expanded configuration with top flaps 21 and pouch opening 15 open for receiving objects. In its expanded configuration, the outer container 20 has been opened up by bending at its fold lines 27 and 30, while bottom flaps 22 have been folded into a closed position along bottom flaps fold lines 29. The pouch 10 appearing in FIG. 2 has followed the side walls of the outer container 20 in FIG. 7, both at the top and the bottom of the pouch 10. Accordingly, pouch top edges 11 are pulled by the adhesive at the interior corners of the outer container applied at the preferred areas 26, shown in FIG. 3, creating opening 15 in the pouch 10 through which objects may be passed for placement within the pouch 10.

What is claimed is:

1. A water-resistant container, comprising:

an outer container having a plurality of walls, the walls affixed to one another at two of their edges to form a tubular section, the walls having widths between their affixed edges, the tubular section having a first end and a second end, the first end having a plurality of flaps attached thereto, the second end having a plurality of flaps attached thereto, the walls of the outer container having interior surfaces facing the interior of the tubular section and exterior surfaces facing the exterior of the tubular section, the outer container having interior corners at the intersection of the interior surfaces of the walls, a pouch having an interior, a first exterior side, a second exterior side, a bottom edge, a right edge, a left edge, a plurality of top edges forming a top opening, a first line on the first exterior side between the right edge and the left edge, a second line on the second exterior side between the right edge and the left edge, the pouch being formed from a flexible and water-resistant material, the pouch residing within the tubular section of the outer container, the flexible and water-resistant material near the first and second lines of the pouch residing near at least two interior corners of the outer container, the top edges of the pouch extending from the first end of the tubular section at leas a distance equal to one-half the width of the narrowest wall of the outer container, the bottom edge of the pouch extending from the second end of the tubular section at least a distance equal to one-half the width of the narrowest wall of the outer container, and means for attaching the flexible and water-resistant material near the first and second lines of the pouch to the interior surfaces of the walls of the outer container near at least two of the interior corners.

2. The water-resistant container of claim 1, wherein the flexible and water-resistant material is also thermally insulative.

3. The water-resistant container of claim 2, wherein the flexible, water-resistant, and thermally insulative material comprises at least one layer of material having bubbles of gas entrapped therein.

4. The water-resistant container of claim 3, wherein the flexible, water-resistant, and thermally insulative material further comprises at least one layer of reflective material.

5. The water-resistant container of claim 4, wherein the means for attaching the pouch to the interior surfaces of the walls of the outer container is applied so as to adhere to the pouch near its first and second lines.

6. The water-resistant container of claim 4, wherein the means for attaching the pouch to the interior surfaces of the walls of the outer container comprises an adhesive.

7. The water-resistant container of claim 4, wherein the means for attaching the pouch to the interior surfaces of the walls of the outer container comprises a releasable adhesive.

8. The water-resistant container of claim 4, further comprising means for sealing the pouch top opening.

9. A thermally insulative container, comprising:

an outer container having a plurality of walls, the walls affixed to one another at two of their edges to form a tubular section, the walls having widths between their affixed edges, the tubular section having a first end and a second end, the first end having a plurality of flaps attached thereto, the second end having a plurality of flaps attached thereto, the walls of the outer container having interior surfaces facing the interior of the tubular section and exterior surfaces facing the exterior of the tubular section, the outer container having interior corners at the intersection of the interior surfaces of the walls, a pouch having an interior, a first exterior side, a second exterior side, a bottom edge, a right edge, a left edge, a plurality of top edges forming a top opening, a first line on the first exterior side between the right edge and the left edge, a second line on the second exterior side between the right edge and the left edge, the pouch being formed from a flexible and thermally insulative material, the pouch residing within the tubular section of the outer container, the flexible and thermally insulative material near the first and second lines of the pouch residing near at least two interior corners of the outer container, the top edges of the pouch extending from the first end of the tubular section at least a distance equal to one-half the width of the narrowest wall of the outer container, the bottom edge of the pouch extending from the second end of the tubular section at least a distance equal to one-half the width of the narrowest wall of the out container, and means for attaching the flexible and thermally insulative material near the first and second lines of the pouch to the interior surfaces of the walls of the outer container near the at least two interior comers.

10. The thermally insulative container of claim 9, wherein the flexible and thermally insulative material is also water-resistant.

11. The thermally insulative container of claim 10, wherein the flexible, thermally insulative, and water-resistant material comprises at least one layer of material having bubbles of gas entrapped therein.

12. The thermally insulative container of claim 11, wherein the flexible, thermally insulative, and water-resistant material further comprises at least one layer of reflective material.

13. The thermally insulative container of claim 12, wherein the means for attaching the pouch to the interior surfaces of the walls of the outer container is applied so as to adhere to the pouch near its first and second lines.

14. The thermally insulative container of claim 12, wherein the means for attaching the pouch to the interior surfaces of the walls of the outer container comprises an adhesive.

15. The thermally insulative container of claim 12, wherein the means for attaching the pouch to the interior surfaces of the walls of the outer container comprises a releasable adhesive.

16. The thermally insulative container of claim 12, further comprising means for sealing the pouch top opening.

* * * * *